US007264183B2

(12) United States Patent
Nyssen et al.

(10) Patent No.: US 7,264,183 B2
(45) Date of Patent: Sep. 4, 2007

(54) PROCESS FOR THE PRODUCTION OF FINELY DIVIDED MILLED MATERIAL

(75) Inventors: Peter-Roger Nyssen, Dormagen (DE); Rainer Elbert, Bergisch Gladbach (DE); Uwe Nussbaum, Dormagen (DE); Egbert John, Langenfeld (DE); Benno Ulfik, Leverkusen (DE)

(73) Assignee: Lanxess Deutschland GmbH, Leverkusen (DE)

( * ) Notice: Subject to any disclaimer, the term of this patent is extended or adjusted under 35 U.S.C. 154(b) by 170 days.

(21) Appl. No.: 11/146,625

(22) Filed: Jun. 7, 2005

(65) Prior Publication Data

US 2006/0086835 A1 Apr. 27, 2006

(30) Foreign Application Priority Data

Jun. 8, 2004 (DE) ..... 10 2004 027 874

(51) Int. Cl.
*B02C 19/06* (2006.01)

(52) U.S. Cl. ..... 241/5

(58) Field of Classification Search ..... 241/5, 241/DIG. 14

See application file for complete search history.

(56) References Cited

U.S. PATENT DOCUMENTS

| | | | |
|---|---|---|---|
| 5,241,117 A | 8/1993 | Maekawa et al. | 564/37 |
| 6,077,339 A | 6/2000 | Nyssen et al. | 106/31.77 |

FOREIGN PATENT DOCUMENTS

| | | |
|---|---|---|
| EP | 69116867 | 12/1992 |
| EP | 0 764 695 | 9/1996 |
| EP | 0 839 879 | 10/1997 |
| JP | 5043811 | * 2/1993 |

* cited by examiner

*Primary Examiner*—Faye Francis
(74) *Attorney, Agent, or Firm*—Norris McLaughlin & Marcus PA

(57) ABSTRACT

The invention relates to an improved process for the production of finely divided blowing agent powders.

12 Claims, 2 Drawing Sheets

PROCESS FOR THE PRODUCTION OF FINELY DIVIDED MILLED MATERIAL

BACKGROUND OF THE INVENTION

The invention relates to an improved process for the production of particularly finely divided milled material, preferably finely divided blowing agent powders having a narrow particle distribution.

Blowing agents are used industrially, inter alia, for the foaming of PVC, rubber, polyolefins, such as polyethylene or polypropylene, and other thermoplastic polymers. The chemical synthesis of azodicarbonamide as one of the most important blowing agents is generally known and is described, for example, in DE-A1-69116867 (U.S. Pat. No. 5,241,117). Today, these blowing agents are used in the form of their finely divided powders, to a lesser extent also in blowing agent formulations as mixtures with activators and/or other blowing agents, and as polymer-specific masterbatches. Depending on the desired application, the blowing agent powders have different particle finenesses, which are obtained by dry milling of the blowing agents after their synthesis and drying.

Customary mechanical milling methods, such as a ball mill, vibratory tube mill, pinned-disc mill or impact mill, are suitable for the dry milling.

Owing to the explosiveness of the products, air-jet mills in the form of spiral jet mills are preferably used, but the disadvantages thereof are a high specific milling energy input and, associated therewith, high milling costs and a broad grain size distribution of the products obtained. In particular, the products milled in this manner still contain so-called "coarse grain", which, in the context of this Application, is understood as meaning fractions of isolated, unmilled coarse particles, which can lead to problems, in particular foam defects, in subsequent use.

It was therefore the object of the present invention to provide an improved process for the milling of material to be milled, preferably of blowing agents, which requires a low specific milling energy input and after which a product free of coarse grain and having a narrow particle distribution is obtained.

SUMMARY OF THE INVENTION

This object was achieved by a process for the production of a milled material, preferably of a blowing agent powder having a narrow particle distribution, characterized in that a) a starting powder, preferably a starting blowing agent powder having a grain size of 5 to 100 μm, preferably 10 to 50 μm, particularly preferably 15 to 30 μm, and a residual moisture content of less than 1% by weight, in particular less than 0.1% by weight.

b) is comminuted by a gas, in particular an inert gas, such as nitrogen and/or air, in a jet mill with integrated or external, dynamic air classifier.

Grain size (or particle size) is understood as meaning the median value $d_{50}$ [μm] of the volume-related particle distribution (50% of the particles of the distribution are smaller and 50% are larger than the median value).

In the context of this Application, the terms grain size and particle size, and grain distribution and particle distribution, are used synonymously.

The milling gas preferably has a dew point at atmospheric pressure of less than 5° C., in particular less than −20° C.

DETAILED DESCRIPTION

The starting blowing agents to be used in the process according to the invention are selected from the conventionally known blowing agents and, according to the invention, are subject to no restrictions. In general, they are solid, crystalline and/or amorphous, organic or inorganic, in particular water-insoluble compounds.

The following may be mentioned by way of example from the group consisting of the organic blowing agents:

azodicarbonamide (ADCA),
hydrazodicarbonamide (HDCA),
oxy-bis-sulpho-hydrazide (OBSH) [=p,p'-oxy-bis(benzenesulphonic acid hydrazide],
toluene-sulpho-hydrazide (TSH) [=p-toluenesulphonic acid hydrazide],
dinitropentamethylenetetranmine (DPT),
5-phenyl-tetrazole (5 PT),
benzene-sulpho-hydrazide (BSH) [=benzenesulphonyl hydrazide),
para-toluene-sulphonyl-semicarbazide (PTSS)

and the salts thereof, in particular alkali metal and alkaline earth metal salts.

In particular, sodium bicarbonate and anhydrous monosodium citrate may be mentioned from the group consisting of the inorganic blowing agents.

Organic blowing agents of said type are preferred. The starting blowing agent is particularly preferably azodicarbonamide.

In the process according to the invention, the starting blowing agents can be used alone or as mixtures with one another.

The starting blowing agents optionally also contain synthesis-related byproducts, salts, acid residues and/or alkali residues. Preferably, however, the starting blowing agents are substantially purified to remove synthesis-related secondary components by means of filtration and/or wash methods prior to drying.

The starting blowing agents to be used according to the invention may contain further generally known additives, such as, for example, stabilizers, fillers, water absorbents, etc.

Tribasic lead sulphate, dibasic phosphites, lead stearate, zinc stearate, zinc carbonate, zinc oxide, barium stearate, aluminium stearate, calcium stearate, dibutyltin maleate, urea, etc. may be mentioned by way of example as stabilizers.

Suitable fillers are those which are known from the prior art, such as, for example, as described in: Lückert, Pigment+Füllstoff Tabellen [Pigment+Filler Tables], 5th Edition, Laatzen, 1994. These are in particular substances which are insoluble in aqueous media.

Calcium carbonate, talc, mica, barium sulphate and in particular water-repellent finely divided, amorphous silicas, very finely divided, optionally water-repellent kaolin or finely divided alumina may be mentioned as examples of inorganic fillers.

Examples of water absorbents are silica gel, zeolite, alumina, magnesium oxide, calcium oxide and organic acid anhydrides and anhydrous inorganic salts, such as, for example, magnesium sulphate, sodium carbonate, magnesium hydroxide, calcium hydroxide, etc.

The blowing agents to be used according to the invention may furthermore also contain organic solvents. Suitable organic solvents are preferably natural, fully synthetic or semisynthetic compounds, and optionally mixtures of these solvents. Preferred solvents are those having a melting point of less than 90° C., in particular solvents which are liquid at room temperature, from the group consisting of the aliphatic, cycloaliphatic or aromatic hydrocarbons, in particular oils, such as, for example, mineral oils, paraffins, isoparaffins, fully synthetic oils, such as silicone oils, semisynthetic oils based on, for example, glycerides of medium and unsaturated fatty acids, essential oils, optionally purified natural oils and fats, esters of natural or synthetic, saturated or unsaturated fatty acids, preferably $C_8$-$C_{22}$-fatty acids, alkylated aromatics and mixtures thereof, such as, for example, Solvesso, alkylated alcohols, in particular fatty alcohols, linear, primary alcohols obtained by hydroformylation, such as, for example, dobanols.

The starting blowing agents to be used according to the invention may furthermore contain surface-active compounds.

According to the invention, there are no restrictions regarding the surface-active compounds to be used, but surface-active compounds are preferably understood as meaning emulsifiers, wetting agents, dispersants, antifoams or solubilizers which are completely or partly soluble or emulsifiable in water. In particular, they may be nonionogenic, anionogenic, cationogenic or amphoteric, or monomeric, oligomeric or polymeric. Particularly preferred compounds are wetting agents and dispersants which have a solubility of more than 0.01 g/l, preferably more than 0.1 g/l, in water at room temperature and which are readily to very readily soluble in organic media, such as polar and nonpolar solvents, hydrocarbons, oils, fats and in particular polymers, and in particular have a solubility of more than 20% by weight, preferably more than 40% by weight, based on the total solution, in said media.

Preferred, nonionic or ionically modified surface-active compounds are selected, for example, from the group consisting of alkoxylates, alkylolamides, esters, amine oxides and alkylpolyglycosides, in particular from the group consisting of the 1. reaction products of alkylene oxides with alkylatable compounds, such as, for example, fatty alcohols, fatty amines, fatty acids, phenols, alkylphenols, carboxamides and resin acids. These are, for example, alkylene oxide adducts from the class consisting of the reaction products of ethylene oxide and/or propylene oxide with:
   - saturated and/or unsaturated fatty alcohols having 6 to 25 C atoms or
   - alkylphenols having 4 to 12 C atoms in the alkyl radical or saturated and/or unsaturated fatty amines having 14 to 20 C atoms or
   - saturated and/or unsaturated fatty acids having 14 to 22 C atoms or
   - hydrogenated and/or unhydrogenated resin acids, or
   - esterification and/or arylation products which are prepared from natural or modified, optionally hydrogenated castor oil fats which are optionally linked by esterification with dicarboxylic acids to give repeating structural units.

Further suitable compounds are those from the group consisting of 2) the sorbitan esters, such as, for example, SPAN®, ICI
3) the reaction products of alkylene oxide with sorbitan esters, such as, for example, Tween®, ICI
4) the block copolymers based on ethylene oxide and/or propylene oxide, such as, for example, Pluronic®, BASF
5) the block copolymers of ethylene oxide and/or propylene oxide on bifunctional amines, such as, for example, Tetronic®, BASF
6) the block copolymers based on (poly)stearic acid and (poly)alkylene oxide, such as, for example, Hyperme®B, ICI
7) the oxyalkylated acetylenediols and acetylene glycols, such as, for example, Surfynol®, AirProducts
8) the oxyalkylated phenols, in particular phenol/styrene-polyglycol ethers of the formula I) and II)

(I)

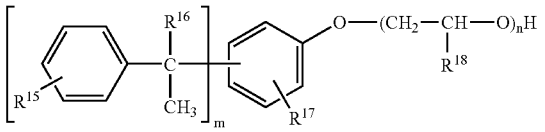

(II)

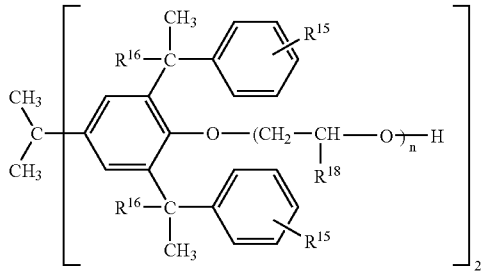

in which $R^{15}$ represents H or $C_1$-$C_4$-alkyl, $R^{16}$ represents H or $CH_3$, $R^{17}$ represents H, $C_1$-$C_4$-alkoxy, $C_1$-$C_4$-alkoxy, $C_1$-$C_4$-alkoxycarbonyl or phenyl, m represents a number from 1 to 14, n represents a number from 2 to 50, preferably from 2 to 30, particularly preferably from 2 to 16, $R^{18}$ represents any unit which has the index n and is identical or different and represents H, $CH_3$ or phenyl,
   a) it being possible for $R^{18}$ to contain only H,
   b) it being possible for $R^{18}$ to contain not more than 60% of $CH_3$, the remainder then representing H or not more than 40% of phenyl, and
   c) it being possible for $R^{18}$ to contain not more than 40% of phenyl, the remainder representing H or not more than 60% of $CH_3$, 9) the ionically modified phenol/styrene-polyglycol ethers of the formula I) or II), as disclosed, for example, in EP-A1-839 879 (=U.S. Pat. No. 6,077,339) or EP-A1-764 695. Ionic modification is understood as meaning, for example, sulphation, carboxylation or phosphation.
   Ionically modified compounds are preferably present as a salt, in particular as an alkali metal or amine salt, preferably a diethylamine salt.

The following may be mentioned as further preferred surface-active compounds:

10) Polymers composed of repeating succinyl units, in particular polyaspartic acid.
11) Ionic or nonionic polymeric surface-active compounds from the group consisting of the homo- and copolymers, graft polymers and graft copolymers and random and linear block copolymers.
   Examples of suitable polymeric surface-active compounds are polyethylene oxides, polypropylene oxides, polyoxymethylenes, polytrimethylene oxides, polyvinyl methyl ethers, polyethylenimines, polyacrylic acids, polyacrylamides, polymethacrylic acids, polymethacrylamides, poly-N,N-dimethylacrylamides, poly-N-isopropylacrlamides, poly-N-acryloylglycinamides, poly-N-methacryloyl-glycinamides, polyvinyloxazolidones, polyvinylmethyloxazolidones.

12) Anionic surface-active compounds, such as, for example, alkyl sulphates, ether sulphates, ether carboxylates, phosphate esters, sulphosuccinamides, paraffmsulphonates, olefinsulphonates, sarcosinates, isothionates and taurates.

13) Anionic surface-active compounds from the group consisting of the so-called dispersants, in particular condensates, which are obtainable by reaction of naphthols with alkanols, addition of alkylene oxide and at least partial conversion of the terminal hydroxyl groups into sulpho groups or monoesters of maleic acid, phthalic acid or succinic acid, and alkylarylsulphonates, such as alkylbenzenesulphonates or alkylnaphthalenesulphonates, and salts of polyacrylic acids, polyethylenesulphonic acids, polystyrenesulphonic acid, polymethacrylic acids, polyphosphoric acids. Preferred are alkylbenzenesulphonates of the formula III (III)

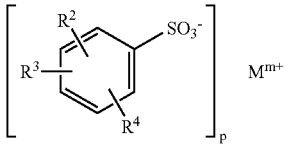

in which $R^2$, $R^3$ and $R^4$ represent H; preferably represent a $C_6$-$C_{18}$-alkyl radical, one of the substituents $R^2$, $R^3$ and $R^4$ not being H; alkylbenzenesulphonates having $R^2$=$R^3$=H and $R^4$=$C_1$-$C_{24}$-alkyl or $C_6$-$C_{18}$-alkyl are preferred; the dodecyl radical is particularly preferred; and p represents 1 or 2, and M represents H, an ammonium radical, such as monoethanol-, diethanol- or triethanolammonium, or an alkali metal, if m=1, and represents an alkaline earth metal, if m=2. M represents in particular H, Li, Na, K, Mg, Ca and Ba.

14) Anionic surface-active compounds from the group consisting of the sulphosuccinic mono- and diesters and their salts.

The sulphosuccinic esters preferably correspond to the formula IV (IV)

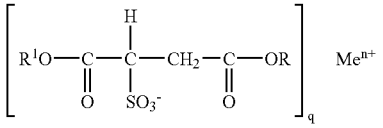

in which

R and $R^1$ represent H or a $C_1$-$C_{24}$-hydrocarbon radical, preferably represent a $C_1$-$C_{24}$-alkyl or aralkyl radical, particularly preferably represent a $C_6$-$C_{18}$-alkyl or aralkyl radical, very particularly preferably 2-ethylhexyl radical, where R and $R^1$ however do not simultaneously denote H, q represents 1 or 2 and Me represents H, an ammonium radical or an alkali metal if n=1, and represents an alkaline earth metal if n=2. Me represents in particular H, Li, K, Mg, Ca, Ba, in particular Na.

Compounds of the formula IV in which R=$R^1$ are furthermore preferred;

15) amphoteric surface-active agents, such as betaines and ampholytes, in particular glycinates, propionates and imidazolines.

Surface-active compounds which are particularly preferred according to the invention are block copolymers based on ethylene oxide and/or propylene oxide, such as, for example, Pluronic®, BASF, optionally ionically modified phenol/styrene-polyglycol ethers of the formula I) and II), alkylbenzenesulphonates of the formula III) and diesters of sulphosuccinic acid and their salts according to formula IV), very particularly preferably sodium bistridecyl sulphosuccinate, such as, for example, Aerosol® TR, Cytec, sodium dioctyl sulphosuccinate, such as, for example, Aerosol® OT, Cytec, sodium dihexyl sulphosuccinate, such as, for example, Aerosol® MA, Cytec, sodium diamyl sulphosuccinate, such as, for example, Aerosol® AY, Cytec, and mixtures of these esters.

According to the invention, mixtures of said compounds may also be used.

In the process according to the invention, the starting blowing agent is continuously fed to the grinding chamber of a jet mill, optionally fluidized, comminuted by means of gas milling jets and are discharged continuously from the grinding chamber together with the milling gas through an external or integrated dynamic air classifier. The jet mill preferably has an integrated air classifier in the form of a rapidly rotating classifying wheel. The jet mill is preferably a fluidized-bed counter-jet mill and/or a dense-bed jet mill having a grinding chamber and milling gas nozzles and an integrated high-speed classifying wheel. These milling units are generally described, for example, in R. Nied, "Die Dichtbettstrahlmühle—eine neue Interpretation der bekannten Spiralstrahlmuihle" [The dense-bed jet mill—a new interpretation of the known spiral jet mill], Aufbereitungstechnik, Part 8 (2002), pages 52-58. "Rapidly rotating" or "high-speed" in the context of the Application means a circumferential speed of more than 1 m/s, preferably more than 3 m/s.

The starting blowing agent is preferably fed continuously to the grinding chamber of a fluidized-bed counter-jet mill in which the starting blowing agent is fluidized and comminuted by means of a milling gas, which is introduced into the grinding chamber under an initial pressure via 1 to 10, in particular 2 to 6, milling gas nozzles, and is discharged continuously from the grinding chamber together with the milling gas through an integrated high-speed classifying wheel.

The initial pressure of the milling gas is preferably less than 12 bar gauge pressure, in particular less than 4.5 bar gauge pressure.

The starting blowing agent having an initial grain size (median value of the volume distribution) of 20-30 μm is preferably comminuted to a grain size of 0.5 to 19 μm, preferably 1 to 19 μm, particularly preferably 2-19 μm, without coarse grain.

Below, the process is explained in more detail using the preferred fluidized-bed counter-jet mill as an example:

Fluidized-bed counter-jet mills usually have a grinding chamber in the form of an upright cylinder having a height to diameter ratio of, for example, about 2 to 1. The base can be substantially flat or can taper to an obtuse cone. Milling nozzles via which the milling gas is released into the grinding chamber are arranged at the lower end of the grinding chamber. The milling gas has an initial pressure between 0.3 and 12 bar gauge pressure, but preferably between 0.5 and 7 bar gauge pressure (bar gauge pressure=total pressure minus atmospheric pressure (1 bar)). In the embodiment having a flat base, the milling nozzles are distributed uniformly along the circumference and directed in their axis towards a common point of intersection. The number of milling nozzles depends on the mill size and, according to the invention, is not limited. For example, between 2 and 6 nozzles are customary industrially.

Embodiments having a conical base part are preferably used for poorly fluidizable, heavy substances; here, one milling nozzle which chiefly serves for fluidizing the material to be milled is used at the vertex of the cone. The axes of the nozzles are arranged in an inclined manner and preferably meet the axis of the base nozzle at a point. In this case, the nozzles are arranged spatially.

The starting blowing agent can be introduced into the grinding chamber via a gravity tube, an injector or a conveyor screw. In the case of gravity tubes, the feed material can be introduced laterally into the grinding chamber, approximately at middle height. In another embodiment, the starting blowing agent is introduced through the grinding chamber cover.

The particles of the feed material enter the region of the milling jets and are taken up and accelerated by the air expanding out of the milling jets. On the outer surface of the milling jets, particles enter everywhere. Depending on the point of entry into the milling jet and the residence time, the particles of material to be milled have different velocities. Highly accelerated particles strike particles which are just entering the jet and still have a low velocity in the jet direction. The particles strike one another with a large velocity difference and are comminuted by mutual particle impact. This process takes place in the milling jets and particularly intensively at the common focal point of the jets. The energy available for comminution depends on the initial pressure and the amount of milling gas. Depending on the specific energy input, the material to be milled can be comminuted to a greater or lesser extent.

In contrast, for example, to spiral jet mills, the flow in the grinding chamber is completely irregular so that no static classification takes place here. An externally driven classifier is therefore arranged, for example, above the milling zone (integrated classifier). Such classifiers are now exclusively in the form of paddle classifiers—also referred to as deflection wheel classifiers. A paddle wheel equipped with closely spaced fine vanes is arranged in the grinding chamber with vertical or horizontal axis, depending on design. It is continuously adjustable in speed with circumferential velocities between 5 and 120 m/s, preferably between 10 and 70 m/s. The milling gas is sucked from the grinding chamber by a downstream fan or forced from the grinding chamber as a result of excess pressure. As a result of the rotation of the classifying wheel, a spiral flow forms. Particles which are carried with the milling gas into the region of the classifying wheel experience inertia and flow forces of different magnitudes, depending on the grain size. Owing to the higher entraining forces of the gas flow, sufficiently fine particles are sucked through the vanes of the classifying wheel. The particles which are still too coarse are repelled by the classifying wheel owing to the higher centrifugal forces and remain in the grinding chamber. This separation according to the grain size—also referred to as classification—is a statistical process and accordingly is not sharp. The so-called cut-off—this is to be understood as meaning the particle size at which half of the particles involved in the classification enter the coarse material (grinding chamber content) and the other half enter the fine material (=milled material)—can be influenced via the circumferential velocity of the classifying wheel and the amount of classifying gas.

In the gap at the transition from the rotating classifying wheel to the stationary outlet for fine material, a pressure drop prevails. If coarse unmilled particles enter this region, they can be discharged directly past the classifying wheel into the milled material and appear there as coarse grain. This is avoided by flushing the gap with gas. The amount of gap flushing gas is less than 20%, preferably less than 10%, based on the amount of milling gas and depending on mill size. The required initial pressure of the flushing gas is below 0.5 bar gauge pressure.

Depending on the design of the mill, and in the case of horizontally arranged classifying shaft, the fine material is discharged laterally from the grinding chamber through a straight pipe or optionally through a spiral discharge pipe, in order to prevent caking of fine milled material. In the case of a vertical classifier shaft, the fine material can be removed laterally from the grinding chamber above the classifying wheel through the grinding chamber cover or below the classifying wheel. In these cases, as a rule the spiral discharge described above is used.

A filter, optionally in combination with a cyclone, is located downstream of the grinding chamber, as a separation element for the milled material.

The degree of comminution in said milling process according to the invention is dependent in particular on the energy introduced via the gas jets and the energy density, based on the volume of the grinding chamber. In the process according to the invention, the specific milling energy input, measured in kJ/kg, based on the starting blowing agent powder introduced, depending on the median value $d_{50}$ of the resulting grain size of milled material, measured in μm, preferably does not exceed the following values:

| | |
|---|---|
| from 2 up to and including 3 μm: | 6000 kJ/kg; |
| from 3 up to and including 4 μm: | 2000 kJ/kg; |
| from 4 up to and including 7 μm: | 1000 kJ/kg; |
| from 7 up to and including 12 μm: | 500 kJ/kg and |
| >12 μm: | 100 kJ/kg |

In the context of this Application, "specific milling energy input" means the energy introduced for milling, based on the product stream through the mill.

Figure 1:
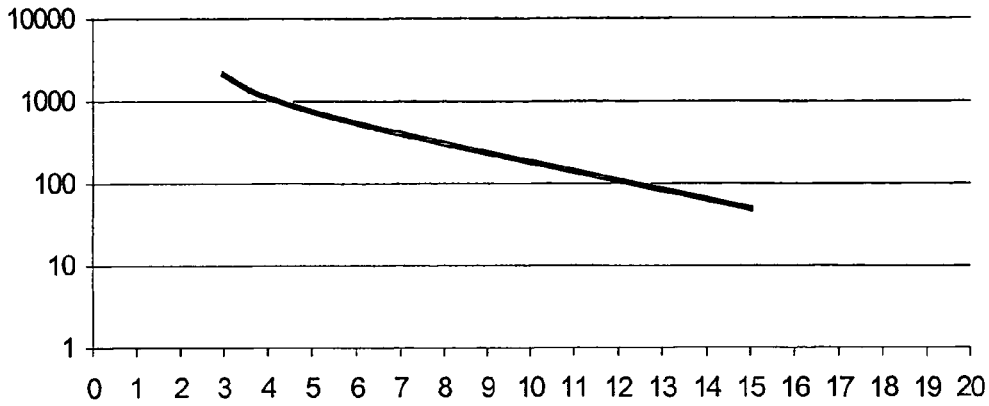
FIG. 1 is a graphical representation of the relationship between the specific milling energy input (kJ/kg) of azodicarbonamide (y-axis) and the median value $d_{50}$ of the grain size of the milled material in μm (x-axis)

This relationship is shown for azodicarbonamide in FIG. 1. The y axis shows the specific milling energy input in kJ/kg of azodicarbonamide, while the x axis shows the median value $d_{50}$ of the grain size of the milled material in μm.

In the process according to the invention, particularly narrow grain distributions of milled material are obtained. The initial pressure of the milling gas, measured in bar gauge pressure and depending on the median value $d_{50}$ of the resulting grain size of milled material, measured in μm, preferably does not exceed the following values:

| | |
|---|---|
| from 2 up to and including 4 μm: | 4.5 bar gauge pressure, in particular 3.5 bar gauge pressure; |
| from 4 up to and including 6 μm: | 3.0 bar gauge pressure, in particular 2.0 bar gauge pressure; |
| from 6 up to and including 12 μm: | 1.5 bar gauge pressure, in particular 1.0 bar gauge pressure; and |
| >12 μm: | 0.8 bar gauge pressure, in particular 0.5 bar gauge pressure. |

The upper limit $d_{99}$ and/or $d_{90}$ of the grain size distributions, measured in μm, depending on the median value $d_{50}$ of the resulting grain size of milled material in the range from 1 up to and including 5 μm, is preferably in accordance with the following formulae:

$$d_{99}=2.9\cdot d_{50}+1.2\ \mu m$$

$$d_{90}=2.12\cdot d_{50}+0.7\ \mu m.$$

Figure 2:
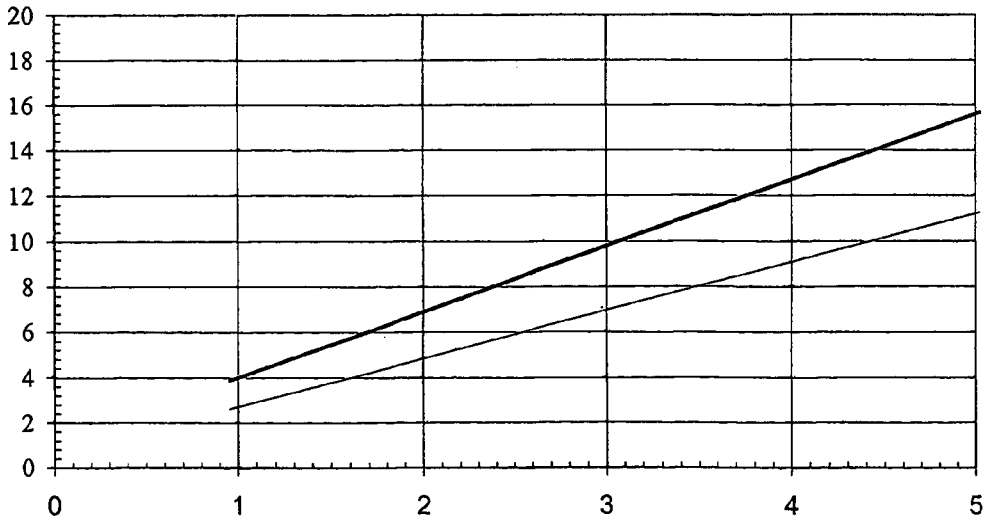
FIG. 2 is a graphical representation of the relationship of the upper limit $d_{99}$ (y-axis, upper line) and upper limit $d_{90}$ (y-axis, lower line) of milled azodicarbonamide, in μm, to the median value $d_{50}$ of the grain size of milled material from 0 up to and including 5 μm.

This relationship is shown for azodicarbonamide in FIG. 2. The y axis shows the value $d_{90}$ (lower line) or $d_{99}$ (upper line) of the grain size of milled material in μm, while the x axis shows the median value $d_{50}$ of the grain size of milled material from 0 up to and including 5 μm.

The upper limit $d_{99}$ and/or $d_{90}$ of the grain size distributions, measured in μm, depending on the median value $d_{50}$ of the resulting grain size of milled material in the range from 5 up to and including 18 μm, is preferably in accordance with the following formulae:

$$d_{99}=4.19\cdot d_{50}-7.47\ \mu m$$

$$d_{90}=2.83\cdot d_{50}-5.68\ \mu m.$$

Figure 3:
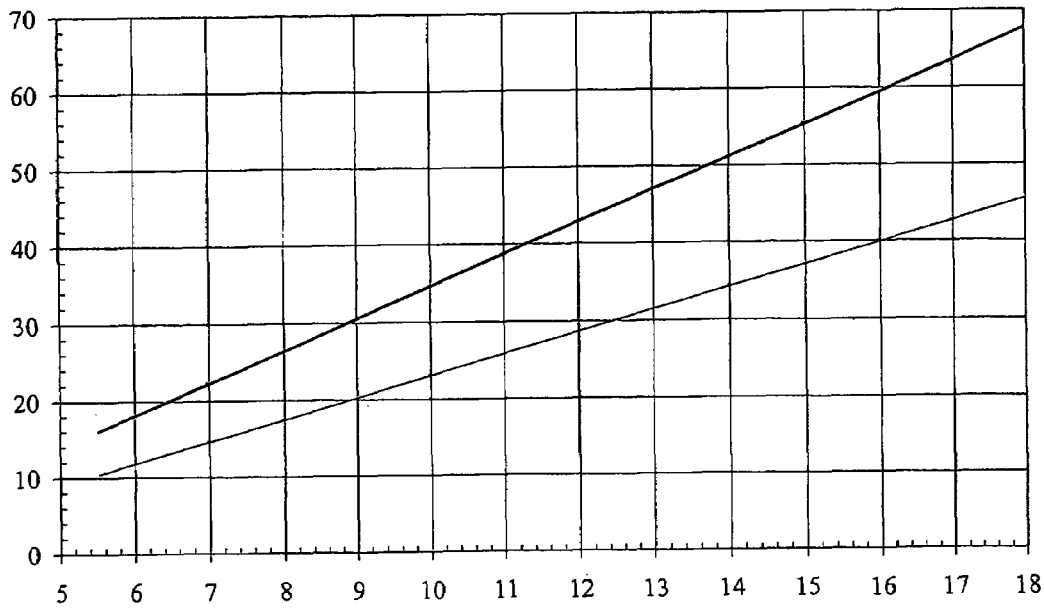
FIG. 3 is a graphical representation of the relationship of the upper limit $d_{99}$ (y-axis, upper line) and upper limit $d_{90}$ (y-axis, lower line) of milled azodicarbonamide, in μm, to the median value $d_{50}$ of the grain size of milled material from 5 up to and including 18 μm.

This relationship is shown for azodicarbonamide in FIG. 3. The y axis shows the value $d_{90}$ (lower line) or $d_{99}$ (upper line) of the grain size of milled material in μm, while the x axis shows the median value $d_{50}$ of the grain size of milled material from 5 up to and including 18 μm.

The invention is explained in more detail on the basis of the following examples, without there being any intention to restrict the invention thereby.

It will be understood that the specification and examples are illustrative but not limitative of the present invention and that other embodiments within the spirit and scope of the invention will suggest themselves to those skilled in the art.

EXAMPLES

Description of the Measuring Methods Used

The grain size determination was effected by means of laser diffraction measurements on powder. The laser diffraction measuring apparatus from SYMPATEC, Helos type, Sensor 207, dispersing system Rodos 1042, was used.

The grain size is understood as meaning the median value $d_{50}$ [μm] of the volume-related grain distribution (50% of the particles of the distribution are smaller than and 50% are larger than the median value). Accordingly, the $d_{10}$ value (10% are smaller), $d_{99}$ value (90% are smaller) and $d_{99}$ value (99% are smaller) are stated as comparable upper limits for describing the width of the grain distribution.

Azodicarbonamide having a grain size $d_{50}$ (median value of the volume distribution) of 21.3 μm, $d_{10}$ of 6.4 μm, $d_{90}$ of 38.5 μm, $d_{99}$ of 59.0 μm and a residual moisture content less than 0.05% by weight (Porofor® ADC E-C2, from Bayer Chemicals AG or LANXESS Deutschland GmbH) was used as a starting blowing agent for the milling operations of the following examples.

All milling operations were effected on a typical commercial fluidized-bed counter-jet mill of the type AFG® 400 from Hosokawa-Alpine, with flat grinding chamber base and integrated dynamic classifying wheel of the type NG® with inclined vanes and an air throughput of 1200 $m^3$/h at room temperature. The feed material (starting blowing agent) was introduced through the grinding chamber cover via a synchronized lock and a gravity tube and thus continuously fed to the grinding chamber, fluidized and comminuted by means of 3 milling nozzles and removed together with the milling air via the dynamic classifying wheel and separated off in a tubular filter and collected. During the milling, the feed of the starting material was regulated so that the amount of product in the grinding chamber remained constant and a stable powder fluidized bed was established.

For comparison, milling operations were carried out on a commercial spiral jet mill of the type LSM having a grinding chamber diameter of 650 mm, using the same starting material.

Whether the milled material still contained coarse grain was determined by laboratory screening five times in each case of 50 g of the milled product using a screen mesh size of 80 μm on a laboratory test screening machine of the type JEL® from Engelsmann. Free of coarse grain meant that a sieve residue was not found on the screen after any sieving operation.

TABLE 1

Experimental parameters for examples 1 to 6, comparative examples 1 to 3:

| | Example | | | | | | Comparative example | | |
|---|---|---|---|---|---|---|---|---|---|
| | 1 | 2 | 3 | 4 | 5 | 6 | 1 | 2 | 3 |
| Grinding chamber load in kg | 13 | 22 | 24 | 30 | 25 | 25 | | | |
| Milled material throughput in kg/h | 273 | 96 | 157 | 272 | 784 | 817 | | | |
| Milling nozzle diameter in mm | 14 | 20 | 20 | 20 | 20 | 20 | | | |
| Initial pressure of milling nozzle in bar gauge pressure | 2.7 | 0.8 | 0.8 | 0.8 | 0.3 | 0.3 | 7.3 | 4 | 3.3 |
| Number of milling nozzles | 3 | 3 | 3 | 3 | 4 | 4 | | | |
| Air throughput in $m^3/h$ | 1217 | 1208 | 1208 | 1208 | 940 | 1163 | 3000 | 1900 | 1600 |
| Milling air loading in kg/kg | 0.187 | 0.066 | 0.108 | 0.188 | 0.695 | 0.585 | | | |
| Classifying wheel speed in rpm | 4200 | 4400 | 3350 | 2300 | 800 | 790 | | | |
| Classifying wheel diameter in m | 0.2 | 0.2 | 0.2 | 0.2 | 0.2 | 0.2 | | | |
| Classifying wheel width in m | 0.12 | 0.12 | 0.12 | 0.12 | 0.12 | 0.12 | | | |
| Free of coarse grain | yes | yes | yes | yes | yes | yes | no | no | no |

TABLE 2

Results for examples 1 to 6, comparative examples 1 to 3

| | Example | | | | | | Comparative example | | |
|---|---|---|---|---|---|---|---|---|---|
| | 1 | 2 | 3 | 4 | 5 | 6 | 1 | 2 | 3 |
| $d_{50}$ in μm | 3.36 | 4.04 | 4.78 | 6.7 | 14.9 | 13.36 | 3.93 | 6.63 | 15.2 |
| $d_{10}$ in μm | 0.88 | 0.88 | 1.04 | 1.48 | 4.31 | 5.41 | 0.88 | 1.25 | 3.61 |
| $d_{90}$ in μm | 7.35 | 8.58 | 9.52 | 13.13 | 29.9 | 31.2 | 8.82 | 18.17 | 34.95 |
| $d_{99}$ in μm | 11.55 | 12.53 | 14.16 | 19.3 | 46 | 47.95 | 13.1 | 24.93 | 58.18 |
| Specific milling energy in kJ/kg of azodicarbonamide | 1203 | 1007 | 616 | 355 | 36 | 43 | 2190 | 724 | 480 |

We claim:

1. A process for the production of a milled material, having a narrow particle distribution, which comprises a) comminuting a starting powder having a grain size of 5 to 100 μm, and a residual moisture content of less than 1% by weight, b) by a gas, in a jet mill having an integrated or external, dynamic air classifiers, c) wherein the gas produces a specific milling energy input which, measured in kJ/kg, based on the starting powder introduced, depending on the median value $d_{50}$ of the resulting grain size of milled material, measured in μm, does not exceed the following values:

| | |
|---|---|
| from 2 up to and including 3 μm: | 6000 kJ/kg; |
| from 3 up to and including 4 μm: | 2000 kJ/kg; |
| from 4 up to and including 7 μm: | 1000 kJ/kg; |
| from 7 up to and including 12 μm: | 500 kJ/kg and |
| >12 μm: | 100 kJ/kg. |

2. A process according to claim 1, wherein the starting powder is a blowing agent powder.

3. A process according to claim 2, wherein the blowing agent powder is azodicarbonamide.

4. A process according to claim 1, wherein the gas is an inert gas and/or air.

5. A process according to claim 4, wherein the gas is nitrogen and/or air.

6. A process according to claim 1, wherein the jet mill is a fluidized-bed counter-jet mill and/or a dense-bed jet mill having a grinding chamber, milling gas nozzles and an integrated high-speed classifying wheel.

7. A process according to claims 6, wherein said jet mill is a fluidized-bed counter-bet mill having a grinding chamber and the starting powder is fed continuously to the grinding chamber of the fluidized-bed counter-jet mill, is fluidized and comminuted by means of said gas, said gas being is introduced into the grinding chamber under an initial pressure via 1 to 10, milling gas nozzles and is discharged continuously from the grinding chamber together with said gas through an integrated high-speed classifying wheel.

8. A process according to claim 1, wherein the initial pressure of said gas is less than 12 bar gauge pressure.

9. A process according to claim 1, wherein the staring powder has an initial grain size of 20-30 μm and is comminuted to a grain size of 0.5 to 19 μm, without coarse grain.

10. A process according to claim 1, wherein the gas is introduced at an initial pressure, measured in bar gauge pressure and depending on the median value $d_{50}$ of the resulting grain size of milled material to be produced, measured in μm, which does not exceed the following values:

| | |
|---|---|
| from 2 up to and including 4 μm: | 4.5 bar gauge pressure, in particular 3.5 bar gauge pressure; |
| from 4 up to and including 6 μm: | 3.0 bar gauge pressure, in particular 2.0 bar gauge pressure; |
| from 6 up to and including 12 μm: | 1.5 bar gauge pressure, in particular 1.0 bar gauge pressure; and |
| >12 μm: | 0.8 bar gauge pressure, in particular 0.5 bar gauge pressure. |

11. A process according to claim 1, wherein the upper limit $d_{99}$ and/or $d_{90}$ of the grain size distributions, measured in μm, depending on the median value $d_{50}$ of the resulting grain size of milled material in the range from 1 up to and including 5 μm, is in accordance with the following formulae:

$$d_{99}=2.9\cdot d_{50}+1.2\ \mu m$$

$$d_{90}=2.12\cdot d_{50}+0.7\ \mu m.$$

12. A process according to claim 1, wherein the upper limit $d_{99}$ and/or $d_{90}$ of the grain size distributions, measured in μm, depending on the median value $d_{50}$ of the resulting grain size of milled material in the range from 5 up to and including 18 μm, is in accordance with the following formulae:

$$d_{99}=4.19\cdot d_{50}-7.47\ \mu m$$

$$d_{90}=2.83\cdot d_{50}-5.68\ \mu m.$$

* * * * *